US009169662B1

(12) United States Patent
Kim

(10) Patent No.: US 9,169,662 B1
(45) Date of Patent: Oct. 27, 2015

(54) MULTIPLE CAST-IN INSERT APPARATUS FOR CONCRETE

(71) Applicant: Hong Nam Kim, Changwon-si (KR)

(72) Inventor: Hong Nam Kim, Changwon-si (KR)

( * ) Notice: Subject to any disclaimer, the term of this patent is extended or adjusted under 35 U.S.C. 154(b) by 0 days.

(21) Appl. No.: 14/548,368

(22) Filed: Nov. 20, 2014

(30) Foreign Application Priority Data

| | | |
|---|---|---|
| Apr. 3, 2014 | (KR) | 10-2014-0039753 |
| Apr. 3, 2014 | (KR) | 10-2014-0039754 |
| Apr. 3, 2014 | (KR) | 10-2014-0039756 |
| Apr. 3, 2014 | (KR) | 10-2014-0039758 |
| May 20, 2014 | (KR) | 10-2014-0060192 |

(51) Int. Cl.
*E04C 5/12* (2006.01)
*E04G 21/14* (2006.01)

(52) U.S. Cl.
CPC ..... *E04G 21/142* (2013.01); *E04C 5/12* (2013.01); *E04C 5/125* (2013.01)

(58) Field of Classification Search
CPC ..... E04G 21/12; E04C 5/12; E04C 5/125; E01C 5/08; E01C 23/04; E04B 1/4121; E04B 1/4135
See application file for complete search history.

(56) References Cited

U.S. PATENT DOCUMENTS

| | | | | |
|---|---|---|---|---|
| 5,415,510 | A * | 5/1995 | Funaki et al. | 411/384 |
| 5,653,078 | A * | 8/1997 | Kies et al. | 52/698 |
| 2007/0235629 | A1 * | 10/2007 | Joslyn | 249/213 |

* cited by examiner

*Primary Examiner* — Patrick Maestri
(74) *Attorney, Agent, or Firm* — Sherr & Jiang, PLLC

(57) ABSTRACT

Disclosed is a multiple cast-in insert apparatus for concrete, including a supporting body fixed to a plate material configured to pour the concrete and having a first screw formed along an inner circumferential surface of a hollow coupling hole formed therein to pass therethrough; a lifting body including a coupling part having a second screw thread formed on an outer circumferential surface thereof to be screwed with the first screw thread and thus to be selectively moved up and down through the hollow coupling hole and also having an anchor coupling hole formed therein, and a leveling support part integrally formed along an upper edge of the coupling part to protrude outward in a radial direction; and a spacer body disposed above the supporting body and having a coupling through-hole formed therein so that the coupling part passes therethrough.

9 Claims, 13 Drawing Sheets

MULTIPLE CAST-IN INSERT APPARATUS FOR CONCRETE

CROSS-REFERENCE TO RELATED APPLICATION

This application claims priority to and the benefit of Korean Application Nos. 10-2014-39753, 10-2014-39754, 10-2014-39756 and 10-2014-39758 which were filed on Apr. 3, 2014, and Korean Application No. 10-2014-60192 which was filed on May 20, 2014 which were hereby incorporated by references as if fully set forth herein.

BACKGROUND

1. Field of the Invention

The present invention relates to a multiple cast-in insert apparatus for concrete, and more particularly, to a multiple cast-in insert apparatus for concrete, in which an anchor for installing various structures is coupled to the concrete so that multiple functions are provided by one apparatus, and thus convenience of construction is enhanced.

2. Discussion of Related Art

Generally, in a concrete pouring operation, a cast is manufactured according to a shape of a building and installed at a pillar forming a frame of the building, and concrete is poured, and if the concrete is dried and cured, the cast is removed.

At this time, an anchor for constructing various structures is coupled to a ceiling of the building formed by the concrete. The anchor may be inserted and coupled into an insert buried in the concrete.

In a method of burying the insert in the concrete, there are a post-install method in which a hole is bored after curing of the concrete, and then the insert is installed in the hole, and a cast-in method in which the insert is disposed at a position, in which the anchor will be installed, in advance, and then the concrete is poured. The cast-in method is mainly used.

FIG. 1 is an exemplary view of a conventional insert.

As illustrated in FIG. 1, the conventional insert 1 has an anchor hole formed in a lower surface thereof. A lower end of the insert 1 is installed at a bottom surface of a cast, concrete c is poured and cured, the cast is removed, an anchor a is coupled in the exposed anchor hole, and then various structures are installed.

At this time, the structures include a duct, a ceiling frame, an electric wiring, and so on. When the various structures are installed at the anchor a, and then a ceiling plate is coupled to the ceiling frame, construction of the ceiling is completed.

However, since the conventional insert 1 has a high supporting force against a load of the anchor a, but the anchor a is directly in contact with and supported by a surface portion of the concrete c, there is a problem in that a crack may be easily generated at the anchor, when a transverse pressure is applied to the anchor a.

Further, since the generated crack is usually propagated to an inner side of the anchor, a coupling force with the insert 1 is weakened, and a supporting force of the concrete c may be reduced.

Also, since a gap is frequently generated between the cast and a lower surface of the insert 1 due to foreign substances, the concrete c may be easily introduced into the anchor hole, and a screw thread formed in the anchor hole may be damaged when the introduced concrete c is removed, and thus it is difficult to install the anchor a.

And in order to construct a connection rebar protruding through a side portion using the concrete, a hole is formed in a side wall portion of the cast, and the connection rebar is inserted, and then the concrete is poured. However, the cast is damaged due to the hole, and thus it is impossible to reuse the cast.

Meanwhile, when a rebar is placed in the concrete c to increase the supporting force of the concrete, a separate rebar spacer is required to place the rebar which is spaced a predetermined height from the cast.

Thus, since an additional material cost and an installation period of time are required to provide and install the insert 1 for installing the anchor a and the rebar spacer for placing the rebar, a construction cost and a period of time are increased. Further, since unnecessary devices are inserted into the concrete c, the supporting force of the concrete c is reduced.

Furthermore, since a thickness of a concrete slab is changed according to a purpose and a size of the building, the spacer should be separately provided and installed to correspond to a changed arrangement distance of the rebar.

Meanwhile, when the concrete c is poured, a leveler such as a height indicating bar is used to check a thickness of the poured concrete through confirmation of levelness of a concrete pouring surface. At this time, separate products having various dimensions corresponding to a state of a bottom surface or a poured height of the concrete should be produced, or a product having a long dimension should be cut and installed according to a dimension of a corresponding construction. When the product having the long dimension is used, there is inconvenience in a work, for example, in which a protruding portion thereof should be removed after a pouring operation of the concrete.

As described above, when the concrete c is poured, in order to separately provide and install the insert 1, the rebar spacer, and the leveler according to a design of the building, the design and the construction become complicated, and the construction cost and period of time are also increased, and thus it is difficult to efficiently perform the construction.

SUMMARY OF THE INVENTION

The present invention is directed to a multiple cast-in insert apparatus for concrete, in which an anchor for installing various structures is coupled to the concrete so that multiple functions are provided by one apparatus, and thus convenience of construction is enhanced.

According to an aspect of the present invention, there is provided a multiple cast-in insert apparatus for concrete, including a supporting body fixed to a plate material configured to pour the concrete and having a first screw formed along an inner circumferential surface of a hollow coupling hole formed therein to pass therethrough; a lifting body including a coupling part having a second screw thread formed on an outer circumferential surface thereof to be screwed with the first screw thread and thus to be selectively moved up and down through the hollow coupling hole and also having an anchor coupling hole formed therein, and a leveling support part integrally formed along an upper edge of the coupling part to protrude outward in a radial direction; and a spacer body disposed above the supporting body and having a coupling through-hole formed therein so that the coupling part passes therethrough.

According to another aspect of the present invention, there is provided a multiple cast-in insert apparatus for concrete, including a supporting body fixed to a plate material configured to pour the concrete and having a hollow coupling hole formed therein to pass therethrough; and a lifting body including a coupling part screwed with the hollow coupling hole to be selectively moved up and down and having an anchor coupling hole formed therein, and a leveling support part formed along an upper edge of the coupling part to integrally protrude outward in a radial direction.

According to still another aspect of the present invention, there is provided a multiple cast-in insert apparatus for concrete, including a supporting body fixed to a plate material configured to pour the concrete and having an extension coupling hole formed therein to pass therethrough; an extension body screwed to the extension coupling hole to be selectively moved up and down and having a hollow coupling hole formed therein to pass therethrough; and a lifting body including a coupling part screwed with the hollow coupling hole to be selectively moved up and down and having an anchor coupling hole formed therein, and a leveling support part formed along an upper edge of the coupling part to integrally protrude outward in a radial direction.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, a multiple cast-in insert apparatus for concrete according to preferred embodiments of the present invention will be described in detail with reference to the accompanying drawings.

Figure 1:
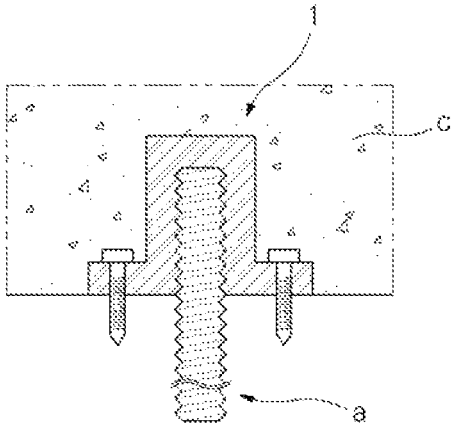
FIG. 1 is an exemplary view of a conventional insert.
Figure 2:
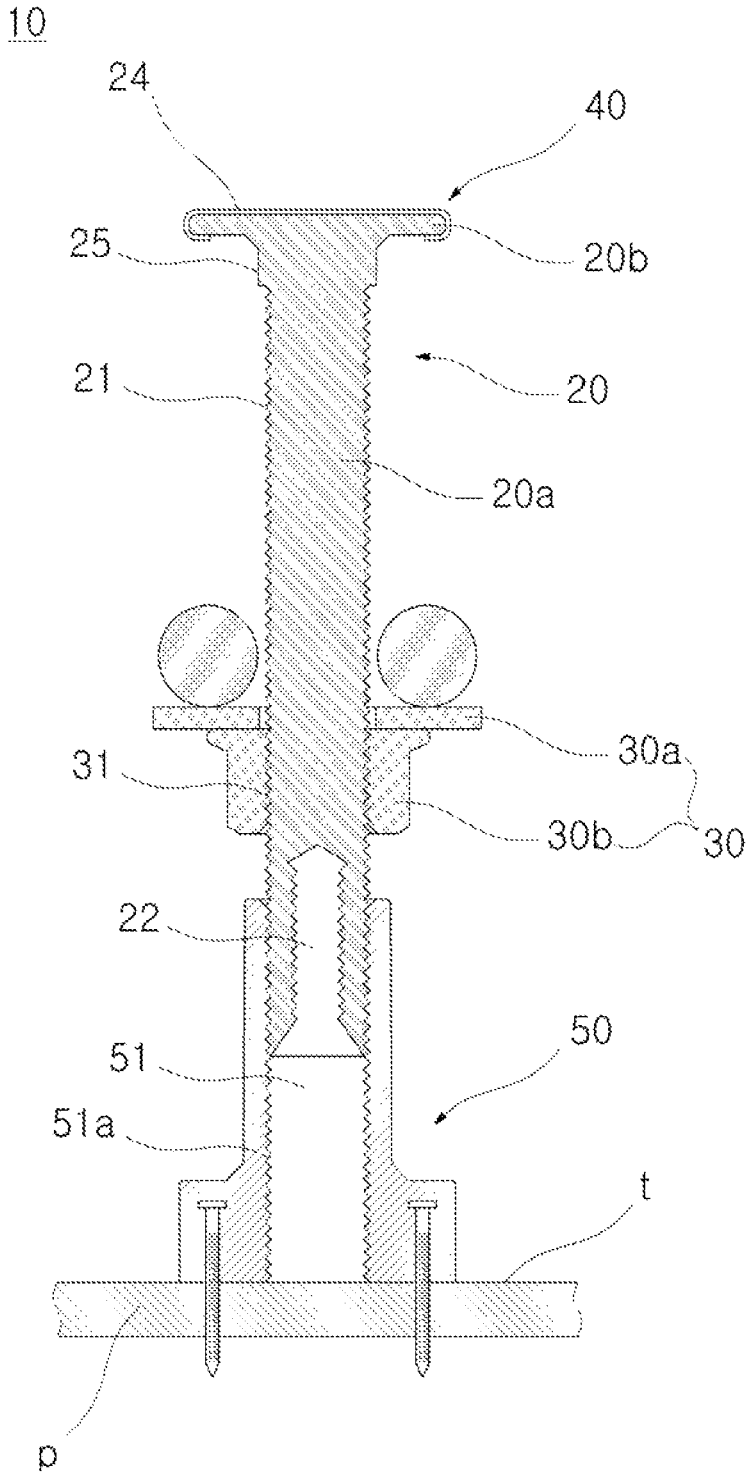
FIG. 2 is a cross-sectional view of a multiple cast-in insert apparatus for concrete according to a first embodiment of the present invention.
Figure 3:
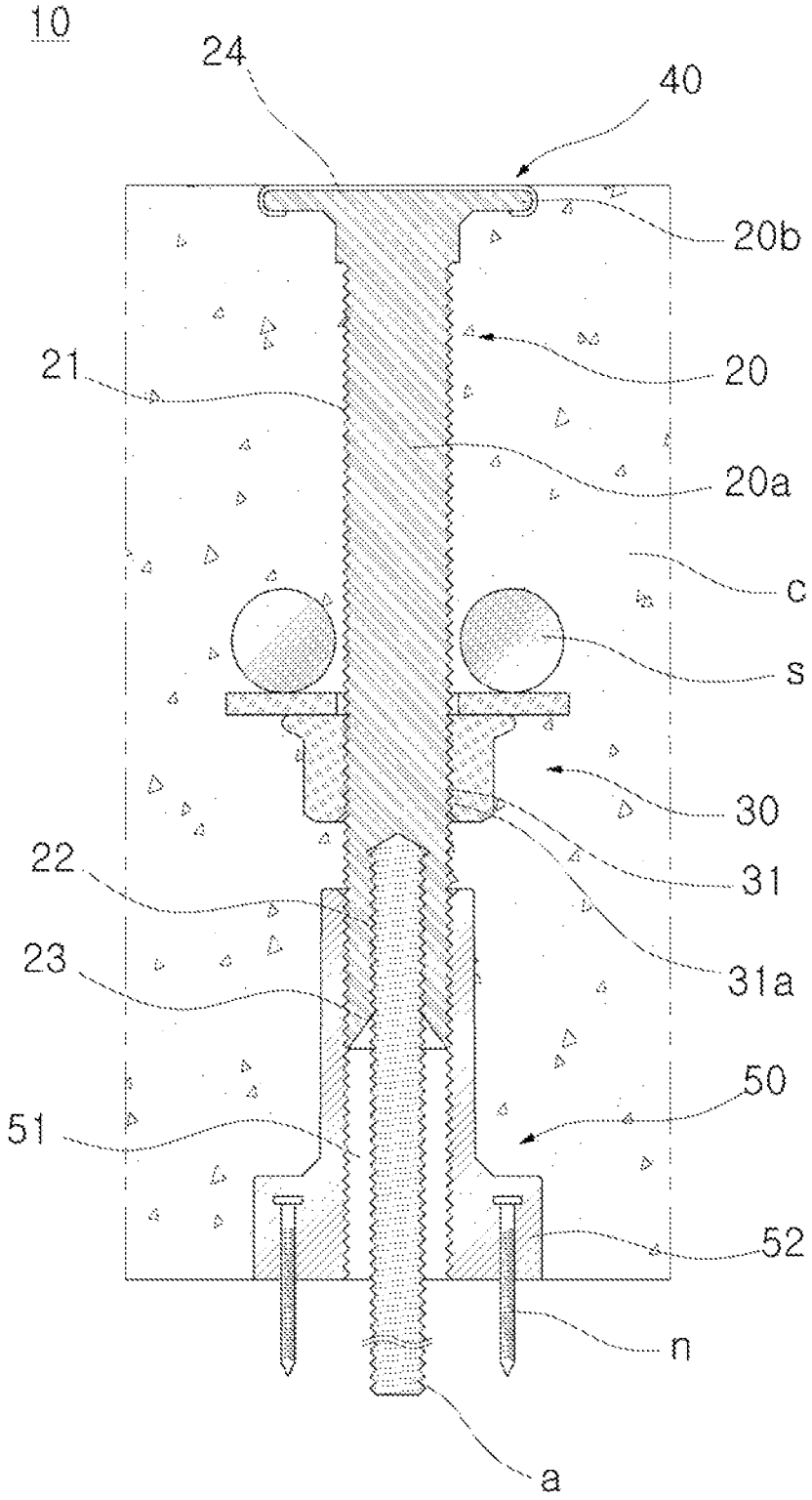
FIG. 3 is an exemplary view illustrating a state in which the multiple cast-in insert apparatus for concrete according to the first embodiment of the present invention is installed in the concrete.
Figure 4:
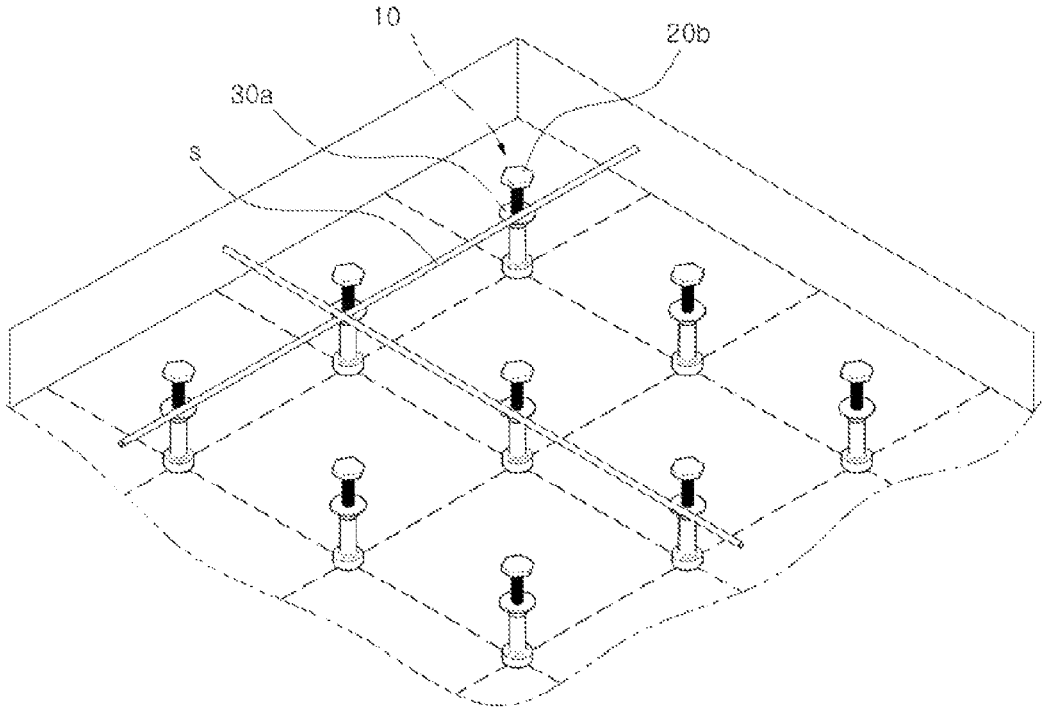
FIG. 4 is an exemplary view illustrating a concrete construction using the multiple cast-in insert apparatus for concrete according to the first embodiment of the present invention.

FIG. 2 is a cross-sectional view of a multiple cast-in insert apparatus for concrete according to a first embodiment of the present invention, FIG. 3 is an exemplary view illustrating a state in which the multiple cast-in insert apparatus for concrete according to the first embodiment of the present invention is installed in the concrete, and FIG. 4 is an exemplary view illustrating a concrete construction using the multiple cast-in insert apparatus for concrete according to the first embodiment of the present invention.

The multiple cast-in insert apparatus 10 for concrete is an apparatus which is installed at a preset arrangement location before the concrete is poured and in which an anchor for installing various structures is inserted and coupled after the concrete is poured.

Further, the multiple cast-in insert apparatus 10 for concrete may be used to supersede a rebar spacer for placing a rebar and a leveler for measuring a pouring height of the concrete other than the installation of the anchor, and may be applied to a concrete construction having various dimensions. Therefore, a design and preparation of the concrete construction may be simplified and thus convenience of construction may be enhanced.

As illustrated in FIGS. 2 to 4, the multiple cast-in insert apparatus 10 for concrete according to the present invention includes a supporting body 50, a lifting body 20, and a spacer body 30.

Herein, the supporting body 50 is fixed to a plate material p for pouring the concrete, and has a first screw thread 51*a* formed along an inner circumferential surface of a hollow coupling hole 51 formed therein. Preferably, the plate material p means a member configured to form a cast in which the concrete is poured to form a pillar, a bottom, a wall, or the like.

For example, the plate material p may be a plywood panel, on which a releasing agent is coated along a concrete injection surface, in the cast which is separated, removed, and then reused after curing of the concrete, when a building is generally constructed. Of course, the plate material p may be formed of various materials such as a synthetic resin and an aluminum material as well as the plywood panel. Also, the plate material may include a structural deck plate formed of a metallic material not to be separated after pouring of the concrete but to be combined with the concrete and thus to increase the supporting force of the concrete, unlike the cast which is separated after pouring of the concrete.

Preferably, the supporting body 50 is fixed to a concrete pouring surface t of the plate material p so as to be buried in the concrete c. Here, it may be understood that the concrete pouring surface includes a horizontally arranged upper surface of the plate material or a vertically arranged inner side surface of the plate material.

The supporting body 50 serves to fix and support the lifting body 20, to which the anchor is coupled, to the plate material p, and may be formed of a metallic material. However, in order to easily perform a forming process and reduce a material cost, the supporting body 50 is preferably formed of a reinforced synthetic resin such as polyacetal(POM) or polyoxymethylene.

Meanwhile, as illustrated in FIG. 2, the supporting body 50 is fixed to the upper surface of the plate material p. When the plate material is removed after the curing of the concrete c, a lower surface of the supporting body 50 may be exposed through a lower surface of the cured concrete c.

At this time, the hollow coupling hole 51 may be formed up and down in the supporting body 50, and exposed through the lower surface of the cured concrete c. Of course, the supporting body 50 may be formed as one tube, and may be formed in a multistage shape to increase an expansion length range. At this time, the supporting body 50 may include an internal body and an external body which are screw-coupled, and the hollow coupling hole may be formed in the internal body.

Meanwhile, the lifting body 20 includes a coupling part 20*a* and a leveling support part 20*b*. Here, the coupling part 20*a* has a second screw thread 21 formed on an outer circumferential surface thereof to be screwed with the first screw thread 51*a* and to be selectively moved up and down through the hollow coupling hole 51, and an anchor coupling hole 22 is formed therein.

At this time, the coupling part 20*a* may be rotated in one direction to be inserted into the hollow coupling hole 51, while being disposed in an upper opening of the hollow coupling hole 51, and may be rotated in the other direction to be withdrawn to an upper portion of the hollow coupling hole 51.

The anchor coupling hole 22 is formed through a lower surface of the coupling part 20*a*. When the plate material p is separated after the curing of the concrete c, an anchor inserted through a lower opening of the hollow coupling hole 51 may be coupled into the anchor coupling hole 22.

Preferably, a screw thread for coupling of the anchor is formed on an inner circumferential surface of the anchor coupling hole 22. At this time, it may be understood that the anchor a has a diameter having a standard size used in a general ceiling construction. The anchor a may be coupled into the anchor coupling hole 22 through the screw thread formed on an outer circumferential surface of the anchor a. The anchor a may be exposed under the concrete c while being coupled into the anchor coupling hole 22, and the various structures constructed on the ceiling may be installed at an exposed end of the anchor a.

Further, an anchor guide part 23 is preferably formed at a lower portion of the anchor coupling hole 22 to be gradually extended toward a lower side and thus to guide the anchor a. Here, the anchor guide part 23 may connect the inner circumferential surface of the anchor coupling hole 22 with an outer circumferential surface of the coupling part 20*a* to be inclined inward and upward in a radial direction. Therefore, when the anchor a is pushed in along the anchor guide part 23, an end of the anchor a is guided into the anchor coupling hole 22, and thus a coupling operation may be easily performed, even though not being confirmed visually.

Further, the leveling support part 20*b* is integrally formed along an upper edge of the coupling part 20*a* to radially protrude to an outer side. An upper surface 24 of the leveling support part 20*b* is preferably formed to be flat, thereby measuring a pouring height of the concrete c. Preferably, the leveling support part 20*b* has a polygonal cross section so that an external rotating force may be accurately transmitted and thus the lifting body 20 may be easily rotated.

The leveling support part 20*b* is inserted into the concrete c, and a lower surface of a protruding portion thereof may be supported by the concrete c and thus firmly coupled with the concrete c. Therefore, the lifting body 20 buried in the concrete may be prevented from being separated downward by a load of the structure installed at the anchor a, and firmly fixed to an inner side of the concrete c.

Of course, the supporting body 50 may be fixed to the plate material which supports a side surface of the concrete c. At this time, when the plate material is separated after the curing of the concrete, the hollow coupling hole is exposed along a side portion of the concrete, and the connection rebar may be inserted through the hollow coupling hole and then coupled into the anchor coupling hole.

Here, it may be understood that the connection rebar is a rebar which protrudes from the ceiling or a side surface of a wall formed of the concrete to be connected with another rebar or to be coupled with other structures. The connection rebar may be simply constructed, even though the plate material is not bored.

At this time, the lifting body 20 is a part which is buried in the concrete to directly support the anchor, and may be formed of a reinforced synthetic resin, such as POM, which has resistance capacity against mechanical stress and fatigue failure. However, the lifting body 20 is preferably formed of a metallic material, such as steel, in consideration of the coupling force with the concrete or the supporting force against the anchor.

Meanwhile, the spacer body 30 is disposed above the supporting body 50, and has a coupling through-hole 31 formed therein so that the coupling part 20*a* passes therethrough. Preferably, the coupling through-hole 31 is formed to have a diameter which is stopped by an upper edge of the supporting body 50.

That is, the coupling part 20*a* passes through the spacer body 30 and is then coupled to the supporting body 50, and the spacer body 30 is moved up and down along the coupling part 20*a* and stopped by an upper end of the supporting body 50. At this time, a rebar s may be seated on an upper surface of the spacer body 30. Here, the spacer body 30 may be formed of a metallic material such as steel or a reinforced plastic material such as POM.

The rebar s may be fixed by a rebar binding wire generally used at a construction site. When the spacer body 30 is formed of the metallic material, the rebar s may be fixed by welding or the like.

As described above, since the lifting body 20 is screwed with the supporting body 50 fixed to the plate material and moved up and down, an upper surface of the leveling support part 20*b* may be disposed in the predesigned pouring height of the concrete and used as a pouring reference surface of the concrete. Therefore, by fixing the rebar to the spacer body 30, it is possible to perform multiple functions of an anchor insert, a leveler, and a rebar spacer with one apparatus.

Meanwhile, a flange 52 which protrudes outward in a radial direction and is coupled to the plate material p by a fastening means may be provided at an outer circumferential surface of the supporting body 50. At this time, various fastening means may be provided according to a material of the plate material p and the supporting body 50.

For example, when the plate material p is formed of the plywood panel, a fixing nail n may be used as the fastening means so that the flange 52 is coupled to the plate material. At this time, the flange 52 may have a nail hole through which the fixing nail is inserted, and the fixing nail n may be insert-molded in the flange 52.

Further, when the plate material p is formed of a fiber-reinforced plastic (FRP) material, the fastening means may be replaced by an adhesive or a double-sided tape provided at a lower surface of the flange 52. And when the plate material p and the supporting body 50 are formed of a metallic material, the flange 52 may be fixed by the welding.

As described above, the lifting body 20 may be coupled in the hollow coupling hole 51, while the supporting body 50 is fixed to the plate material, and thus supported to be spaced from the plate material p. Therefore, even though a gap between the plate material p and the supporting body 50 is generated by a foreign substance, and the concrete is introduced into the hollow coupling hole 51, the introduced concrete is prevented from flowing into the anchor coupling hole 22, and thus the screw thread of the anchor coupling hole 22 may be prevented from being contaminated.

That is, even though a removing operation in which the concrete attached and cured onto the screw thread formed on an inner circumferential surface of the hollow coupling hole 51 is broken or scraped off is not performed with difficulty, the anchor a may be easily inserted and coupled into the anchor coupling hole 22, as long as a hole configured to expose the anchor coupling hole 22 is formed.

Further, since the supporting body 50 is separately provided from the lifting body 20, an external force, such as a pressure and an impact, applied from an outer side, when the concrete in the hollow coupling hole 51 is removed to expose the anchor coupling hole 22, may be absorbed by the supporting body 50, and blocked by a portion thereof screwed with the lifting body 20. Therefore, the screw thread formed in the anchor coupling hole 22 may be prevented from being damaged by the external force, and the anchor a may be easily coupled.

Preferably, a stopper 25 which is stopped by the upper edge of the supporting body 50 to restrict the screw-coupling is provided at an upper end of the second screw thread 21 formed on the outer circumferential surface of the coupling part 20*a*.

At this time, the stopper 25 serves to restrict an insertion depth of the coupling part 20*a* into the hollow coupling hole 51. Through this, a distance between the anchor coupling hole 22 of the lifting body 20 and the plate material p may be sufficiently maintained to prevent introduction of the concrete. Here, the supporting body 50 may be formed in a polygonal pillar shape, such as square to octagonal pillars, or a cylindrical shape. However, it is preferable that the supporting body 50 is formed in the cylindrical shape so that a volume thereof occupied in the concrete, while the hollow coupling hole 51 is formed, is minimized.

Meanwhile, the lifting body 20 is coupled to the plate material p by the supporting body 50, and an outer surface of the lifting body 20 may be directly inserted into and combined with the concrete to be firmly fixed after the curing of the concrete.

That is, as the leveling support part 20*b* which protrudes outward from the outer circumferential surface of the coupling part 20*a* is inserted into the concrete, the supporting force against the load may be enhanced. A contact area with the concrete c is increased through the second screw thread 21 formed along the outer circumferential surface of the coupling part 20*a* to be screwed in the hollow coupling hole 51, and the coupling force with the concrete c is further enhanced by an engagement due to a concavo-convex shape.

At this time, since the lifting body 20 is not supported by a surface of the concrete c, but supported by an inner side of the concrete which is condensed by a load of a peripheral portion and firmly combined with the peripheral portion, the supporting force against the load may be improved, and a crack and an induced propagation of the crack due to a transverse pressure may be prevented.

Further, the outer circumferential surface of the coupling part 20*a* in which the anchor a is inserted is covered by the supporting body 50, and thus even when the transverse pressure is applied to the anchor a, the pressure may be relieved by the supporting body 50, and thus the concrete may be prevented from being damaged due to the crack.

Furthermore, a clearance separated from the concrete may be formed between the anchor a coupled to the coupling part 20*a* and the inner circumferential surface of the hollow coupling hole 51. That is, since the anchor coupling hole 22 is arranged in the hollow coupling hole 51 in a multistage manner to have an inner diameter smaller than that of the hollow coupling hole 51, the clearance may be formed at the outer circumferential surface of the anchor a. The anchor a may be moved left and right in the clearance to relieve the transverse pressure.

Since the clearance is formed at an inner side of the hollow coupling hole 51, a protruding length of the anchor for ensuring a movement of the anchor a may be minimized, and space efficiency may be enhanced.

Also, since the clearance between the hollow coupling hole 51 and the anchor is separated from the concrete, various finishing treatments after the coupling of the anchor such as waterproofing, sealing, and acoustic insulating may be performed at the inner side of the hollow coupling hole 51 without any chemical damage of the concrete, and thus construction quality may be improved.

For example, when a coupling portion between the anchor and the anchor coupling hole 22 is sealed/waterproofed against a humid environment or finished against a noise/water leak to improve an indoor environment, a component which deteriorates the coupling structure of the concrete c may be contained, and the component may be blocked by the supporting body 50 and prevented from being in contact with the concrete.

Thus, durability of a product may be improved, and the lifting body 20 may be manufactured with a low-priced steel material and may provide a high supporting force even in the humid environment, and the present invention may be applied in various construction environments and thus may have high economic feasibility and reliability. Also, the lifting body 20 which is directly coupled with the concrete and provides the supporting force against the anchor may be formed by the metallic material to provide a strong fixing force, and the supporting body 50 which fixes the lifting body 20 to the cast may be formed of the reinforced synthetic resin. Due to diversification of the material, a manufacturing cost may be reduced. Therefore, a production cost may be reduced, while a strong structure may be provided, and economic feasibility and reliability of the product may be enhanced.

Meanwhile, the spacer body 30 may include a coupling body 30*b* having a third screw thread 31*a* formed along an inner circumferential surface thereof to be screwed with the second screw thread 21 and thus to be selectively moved up and down along the coupling part 20*a*, and a seating part 30*a* provided on an upper end of the coupling body 30*b* to be extended outward in a radial direction.

Here, the coupling body 30*b* and the seating part 30*a* may be integrally formed. However, for the sake of convenience of forming, an example in which the coupling body 30*b* and the seating part 30*a* are separately provided is illustrated. Preferably, the coupling through-hole 31 includes a first coupling through-hole formed in the coupling body 30*b* and a second coupling through-hole formed in the seating part 30*a*.

At this time, the coupling body 30*b* may have a polygonal cross section to be easily rotated. Preferably, the coupling body 30*b* has a hexagonal cross section.

The coupling body 30*b* is screwed with the coupling part 20*a*, and thus may be selectively moved up and down according to a rotating direction thereof.

Therefore, when the lifting body 20 is moved up and down so that the leveling support part 20*b* is disposed at a predesigned height of the pouring surface of the concrete, the coupling body 30*b* may be moved up and down in a height corresponding to the height of the pouring surface of the concrete. Therefore, since the multiple cast-in insert apparatus for concrete may arrange and support the rebar at an accurate height, accuracy and convenience of the construction may be enhanced.

Further, the seating part 30*a* forms a supporting surface on the upper end of the coupling body 30*b* which protrudes outward from an upper edge of the coupling body 30*b* so that the rebar s may be seated thereon.

Since the rebar is seated and fixed to the seating part 30*a*, and the concrete is poured along the plate material, the rebar may be accurately arranged at a position corresponding to a pouring thickness of the concrete.

At this time, since the rebar may be temporarily supported at the height arranged by the seating part 30*a*, a binding operation or a welding operation for fixing the rebar may be easily performed without assistance of another operator.

As described above, the multiple functions of the anchor insert, the leveler, and the rebar spacer may be performed with one apparatus, and a pouring height standard of the concrete may be provided according to various thicknesses of the concrete, and an arrangement position of the rebar may be controlled.

Therefore, the rebar may be easily placed at the accurate height without a process which provides a separate rebar spacer in every construction or a rebar spacer having a standard size corresponding to the pouring height of the concrete to be constructed, and thus the accuracy and the convenience of the construction may be improved.

At this time, preferably a distance between the rebar and a lower surface of the concrete c is maintained to be 7 cm or more, thereby preventing a crack from being generated at the lower surface of the concrete c, when a pressure is applied to the lower surface of the concrete c by the rebar s. To this end, a longitudinal length of the supporting body 50 is preferably 5 to 7 cm.

Meanwhile, a barrier cover 40 which seals a boundary portion with the concrete c by absorbing water and thus expanding may be provided at an upper portion of the lifting body 20. Here, the barrier cover 40 may cover upper and side surfaces of the leveling support part 20*b* and may be caught and fixed by a lower surface of the leveling support part 20*b*.

At this time, the barrier cover 40 may be selectively provided when the upper surface of the leveling support part 20*b* is exposed to an outer side of the concrete c and used as the leveler. Preferably, the barrier cover 40 is provided when a pouring position of the concrete c corresponds to a water leak occurring section, such as a kitchen and a bathroom, in which water supply and drainage pipes are located.

Preferably, the barrier cover 40 is formed of a waterproofing material including a rubber material, a silicon material, or a bentonite material. In particular, when the water leak occurs, the barrier cover 40 formed of the bentonite material may be expanded and thus may more accurately seal the boundary portion with the concrete. That is, as the leveling support part 20*b* is exposed above the concrete, the boundary portion between the concrete and the leveling support part 20*b*, which is vulnerable to the water leak, can be sealed, and corrosion of the lifting body 20 due to introduction of water can be prevented.

The water introduced into the concrete may reduce a binding force between particles of the cured concrete, a crack may be generated, the generated crack may be easily propagated to the inner side of the concrete, and thus the durability of a building may be deteriorated. At this time, since the barrier cover 40 seals the boundary portion between the leveling support part 20*b* and the concrete and prevents water permeation, the safety and reliability of the construction may be improved.

Meanwhile, referring to FIG. 4, when the plate material for concrete construction is installed, the multiple cast-in insert apparatus 10 for concrete may be installed at each position in which the anchor a will be arranged.

At this time, in the multiple cast-in insert apparatus 10 for concrete installed at each position, the lifting body 20 may be moved up and down to the predesigned pouring height of the concrete, and the upper surface of the leveling support part 20*b* may be used as a pouring reference surface of the concrete. And the spacer body 30 may be moved up and down to an arrangement height of the rebar corresponding to the pouring height of the concrete, and the rebar s may be coupled and arranged on the seating part 30*a*.

As described above, the supporting body 50 may be installed at each position in which the anchor will be arranged, and the lifting body 20 and the spacer body 30 may be moved up and down to correspond to the pouring height of the concrete having various thicknesses and the arrangement height of the rebar, and thus the functions of the rebar spacer and the leveler may be compatibly performed. Therefore, since the entire construction may be performed with only one kind of apparatus, design and preparation of the construction may be simplified, and the convenience of the product may be enhanced.

Furthermore, since inconvenient processes in which various apparatuses such as the rebar spacer, the leveler, and the insert are separately stored, each apparatus is prepared as required in every construction, and the insufficient apparatus is separately purchased may be eliminated, and only one kind of apparatus may be compatibly used according to a situation of the construction, the convenience of the construction may be considerably improved.

Further, since it is not necessary to install an individual apparatus at various positions in which the rebar will be supported, the height of the concrete will be measured, and the anchor will be installed, and only one apparatus is installed, the construction may be simply performed, and internal inserts which reduce strength of the concrete may be minimized, and thus the safety of the construction may be enhanced.

Figure 5:
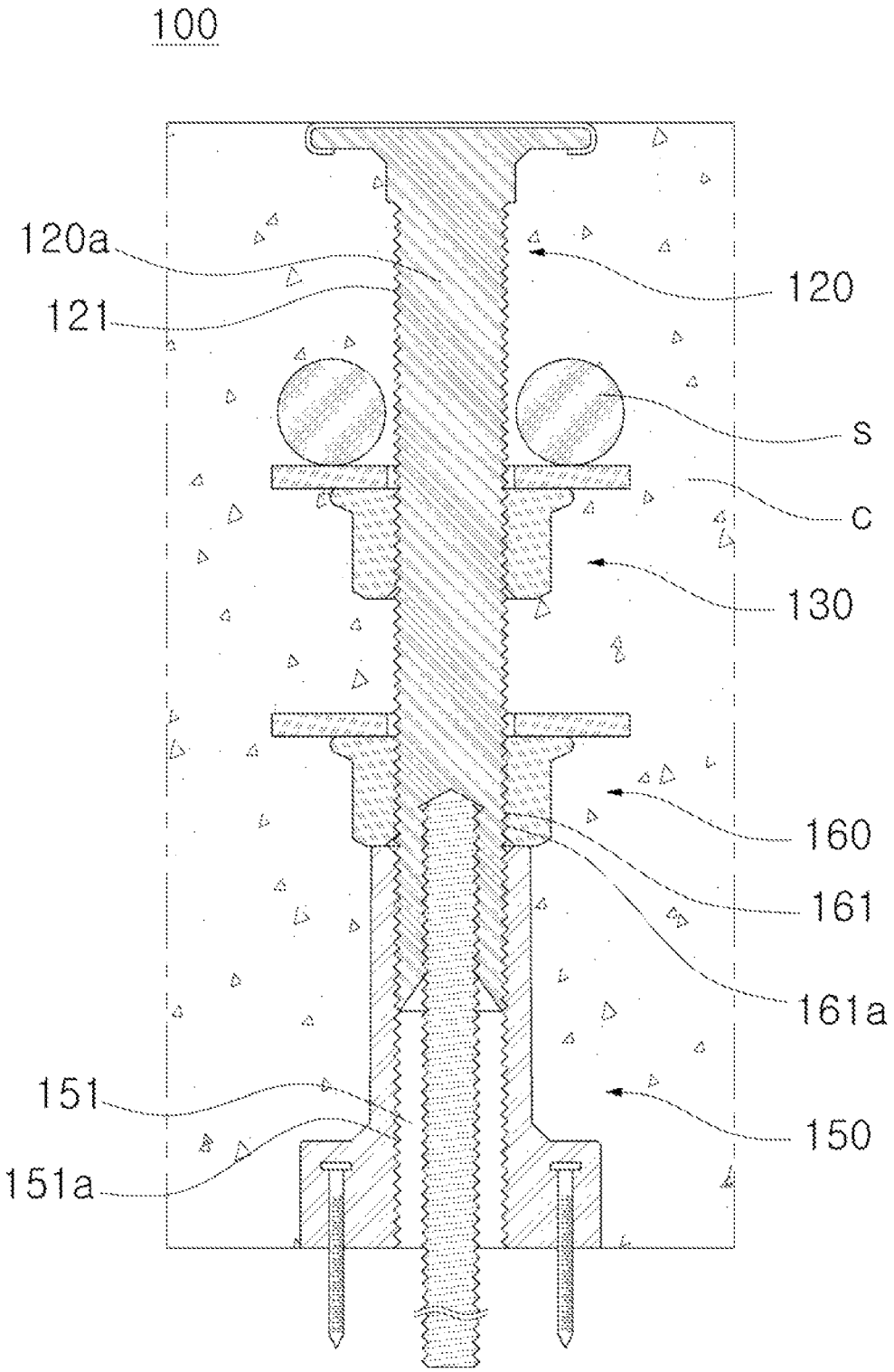
FIG. 5 is an exemplary view illustrating a state in which a multiple cast-in insert apparatus for concrete according to a second embodiment of the present invention is installed in the concrete.

Meanwhile, FIG. 5 is an exemplary view illustrating a state in which a multiple cast-in insert apparatus for concrete according to a second embodiment of the present invention is installed in the concrete. In the second embodiment, since basic configuration, except that a stopper body 160 is provided between a spacer body 130 and a supporting body 150, is the same as that of the first embodiment, the detailed description thereof will be omitted.

As illustrated in FIG. 5, the stopper body 160 having a fourth screw thread 161*a* formed along an inner circumferential surface of a press coupling hole 161 to be screwed with a second screw thread 121 is preferably provided between an upper end of the supporting body 150 and the spacer body 130 to press the upper end of the supporting body 150, when the stopper body 160 is moved down, and thus to fix a lifting body 120.

Here, the stopper body 160 may be screwed onto a coupling part 120*a* to be moved up and down, and may be moved down along the coupling part 120*a* to fix the lifting body 120, when the lifting body 120 is moved up and down to a predesigned pouring height of the concrete.

Specifically, when the stopper body 160 is rotated in the other direction, the stopper body 160 is moved down along the second screw thread 121 formed on an outer circumferential surface of the coupling part 120*a*. When the stopper body 160 is in contact with the upper end of the supporting body 150, the stopper body 160 is not moved down any more, presses the upper end of the supporting body 150, and pushes and presses the lifting body 120 upward.

At this time, a first screw thread 151*a* of a hollow coupling hole 151 and the second screw thread 121 of the coupling part 120*a* are pressed up and down to each other, and the lifting body 120 may be fixed not to be rotated.

Therefore, when the concrete is poured, the lifting body 120 may be prevented from being rotated by a moving pressure after controlling of a height thereof, and thus the height of the lifting body 120 may be prevented from being changed. Thus, a more accurate pouring standard may be provided, and the accuracy of the construction may be enhanced.

Here, the spacer body 130 and the stopper body 160 are individually named according to each function, and may have the same shape. The spacer body 130 and the stopper body 160 may be used compatibly.

Figure 6:
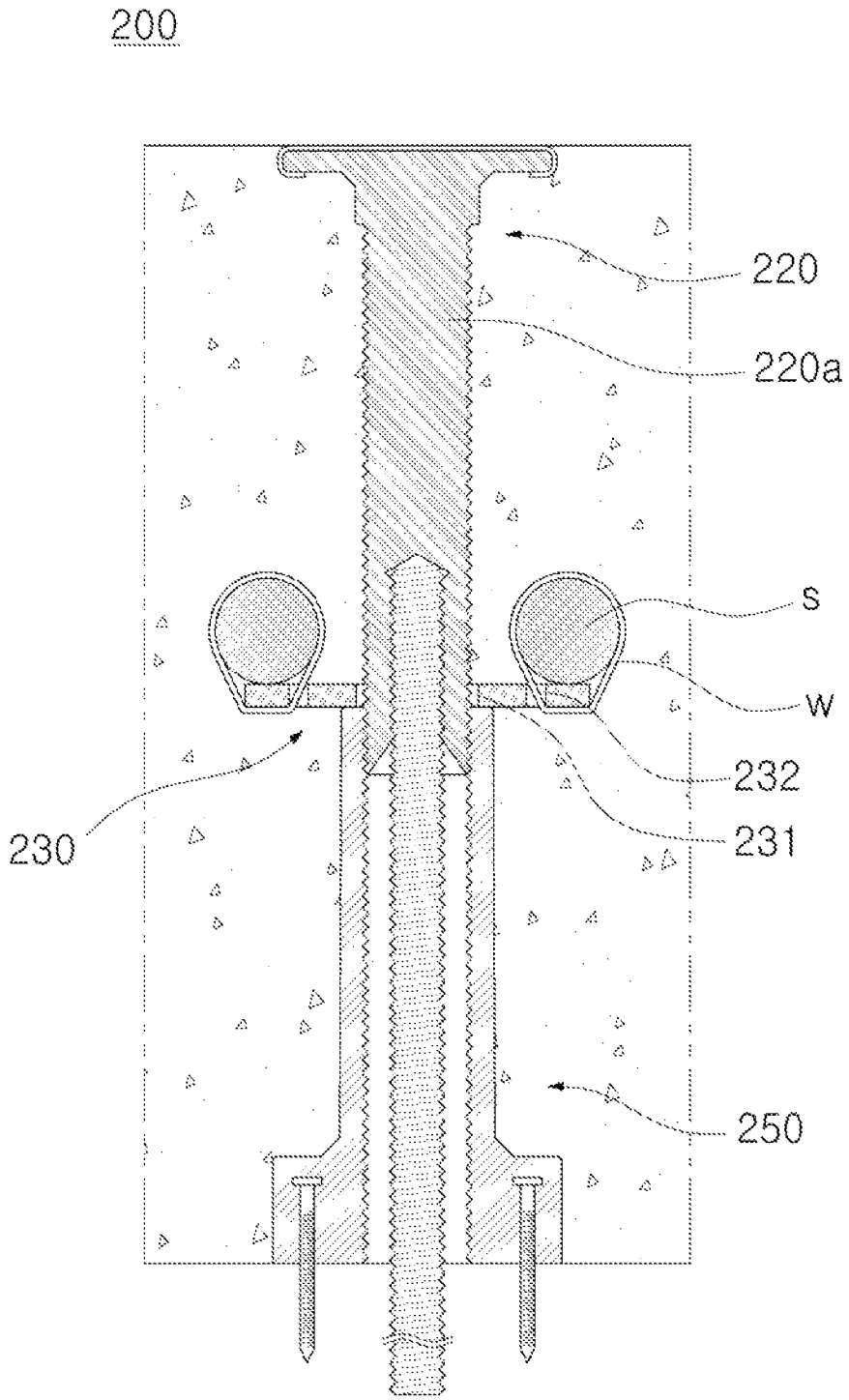
FIG. 6 is an exemplary view illustrating a state in which a multiple cast-in insert apparatus for concrete according to a third embodiment of the present invention is installed in the concrete.

FIG. 6 is an exemplary view illustrating a state in which a multiple cast-in insert apparatus for concrete according to a third embodiment of the present invention is installed in the concrete. In the third embodiment, since basic configuration, except a shape of a spacer body 230, is the same as that of the first embodiment, the detailed description thereof will be omitted.

As illustrated in FIG. 6, the spacer body 230 may have a coupling through-hole 231 formed therein so that a coupling part 220*a* passes therethrough. Preferably, the coupling through-hole 231 may be formed to have a diameter which is caught by an upper edge of a supporting body 250.

That is, the coupling part 220*a* may pass through the spacer body 230 and may be coupled to the supporting body 250, and the spacer body 230 may be moved up and down along the coupling part 220*a* and may be caught and supported by an upper end of the supporting body 250.

At this time, the rebar s may be seated on an upper surface of the spacer body 230. The spacer body 230 may be formed of a metallic material or a reinforced plastic material such as POM.

Meanwhile, the spacer body 230 is formed in a thin circular plate shape, and preferably has a plurality of wire insertion holes 232 formed along an outer area of the coupling through-hole 231 so that a rebar binding wire w is inserted and bound. Here, it may be understood that the rebar binding wire w means a wire which is generally used to fix the rebar in the construction site.

While the spacer body 230 is caught an supported by the upper edge of the supporting body 250, the rebar s is seated on the upper surface of the spacer body 230, and the rebar binding wire w is inserted into each wire insertion hole 232 to bind and fix the rebar s.

Accordingly, the rebar s may be easily fixed regardless of the material of the spacer body 230, and may prevent the rebar from being moved by a pressure when the concrete is poured, and thus the accuracy of the construction may be enhanced. Meanwhile, FIG. 7 is a cross-sectional view of a multiple cast-in insert apparatus for concrete according to a fourth embodiment of the present invention, and FIG. 8 is an exemplary view illustrating a state in which the multiple cast-in insert apparatus for concrete according to the fourth embodiment of the present invention is installed in the concrete.

In the fourth embodiment, since basic configuration, except a shape of a supporting body 350 and that a through guide part 370 is coupled to a lower end of the supporting body 350, is the same as that of the first embodiment, the detailed description thereof will be omitted.

Figure 7:
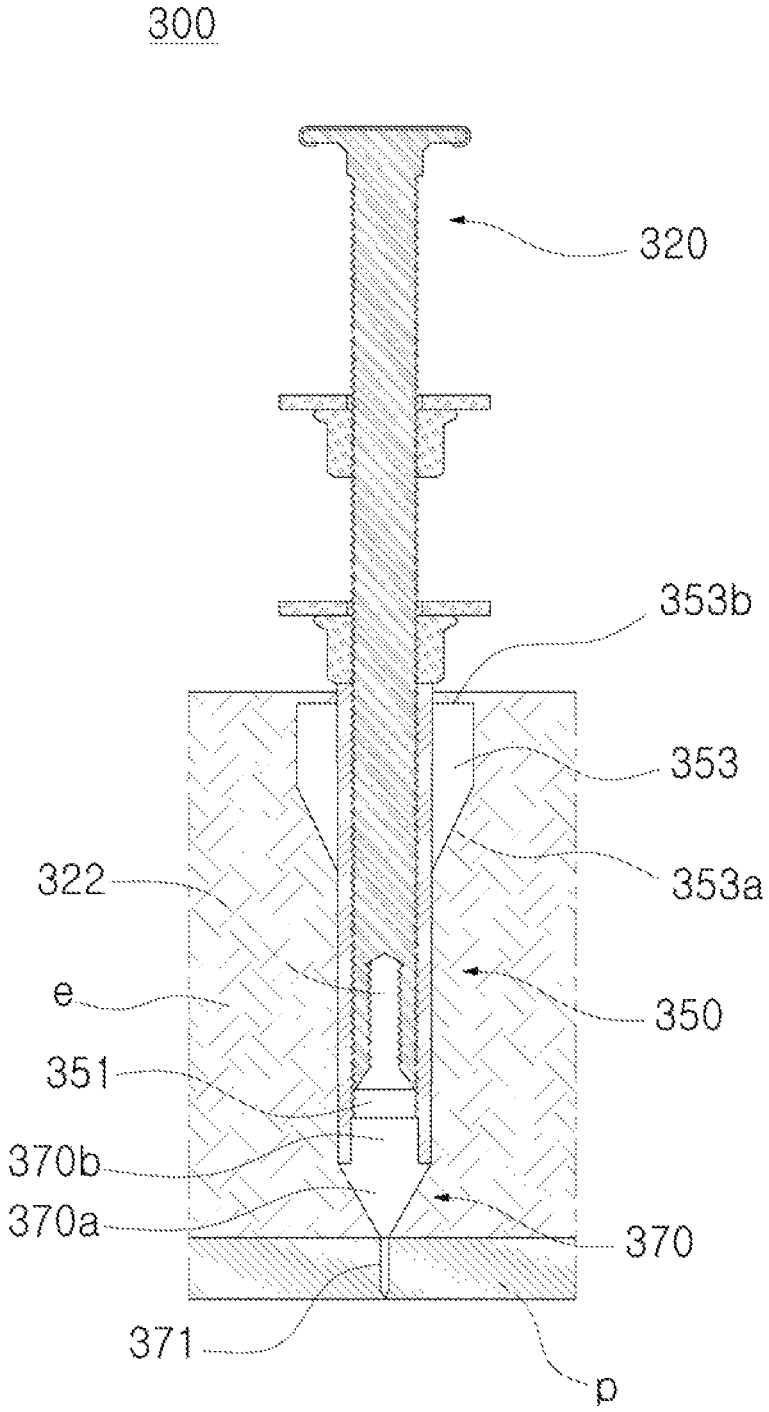
FIG. 7 is a cross-sectional view of a multiple cast-in insert apparatus for concrete according to a fourth embodiment of the present invention.
Figure 8:
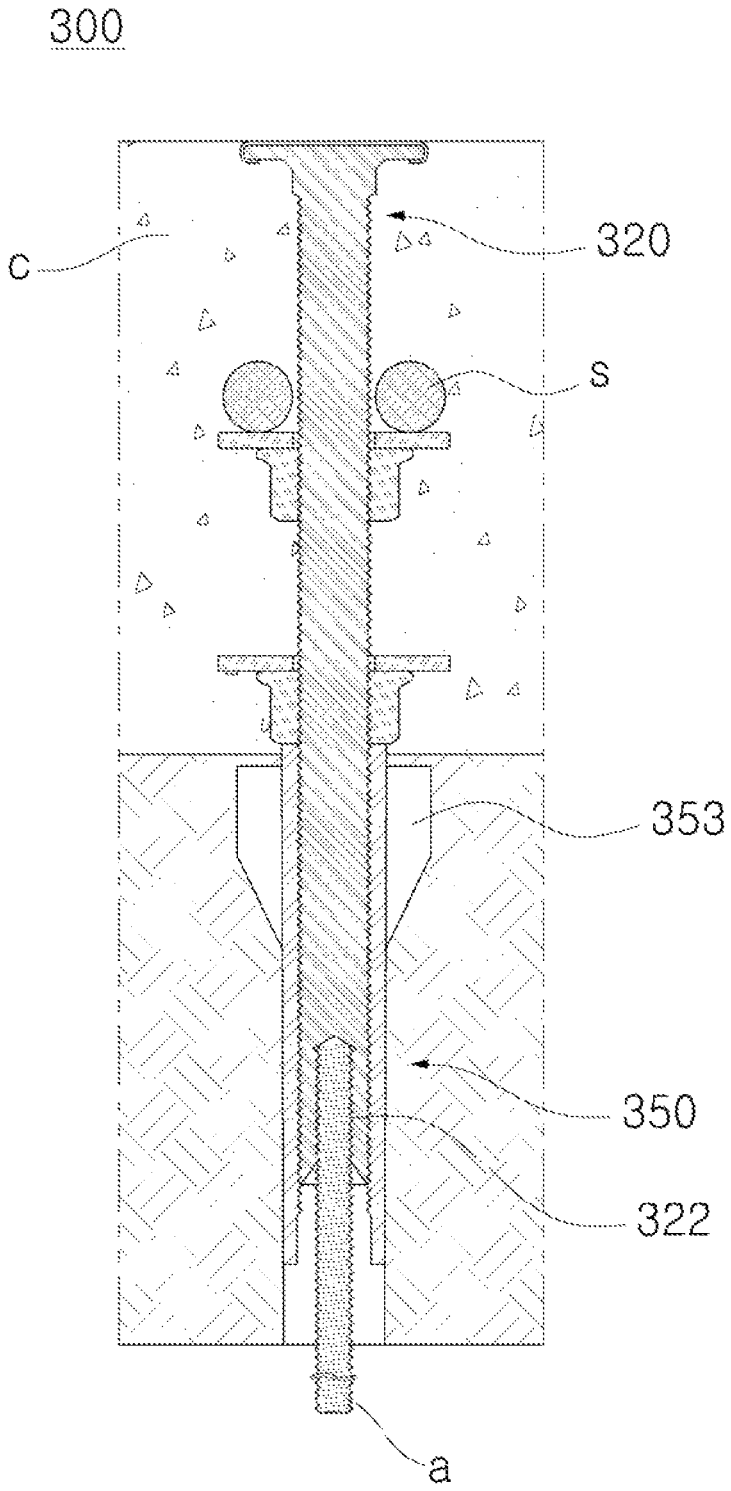
FIG. 8 is an exemplary view illustrating a state in which the multiple cast-in insert apparatus for concrete according to the fourth embodiment of the present invention is installed in the concrete.

As illustrated in FIGS. 7 and 8, preferably the multiple cast-in insert apparatus 300 for concrete further includes the through guide part 370 removably coupled to a lower portion of the supporting body 350.

Here, when an insulator e is provided at a lower portion of the ceiling of a building or in a wall of the building, the multiple cast-in insert apparatus 300 for concrete may pass through the insulator e and may be fixed to the plate material p.

At this time, the insulator e may be formed of Styrofoam or the like to prevent emission of inner heat of the building. While the insulator e is disposed on an inner surface or an upper surface of the plate material p, the concrete may be injected.

While the multiple cast-in insert apparatus 300 for concrete passes through the insulator e and is fixed to the plate material p, the concrete is poured, and thus multiple cast-in insert apparatus 300 for concrete may be fixed to the inner side of the concrete, and the insulator e may be firmly fixed to the concrete c.

Meanwhile, the through guide part 370 preferably includes a coupling portion 370*b* which is removably coupled to a lower portion of a hollow coupling hole 351, and a wedge-shaped through portion 370*a* which becomes narrow downward so as to pass through the insulator e provided along the plate material p.

Here, the wedge shape means a shape of which a lower portion is narrower than an upper portion. An upper portion of the through portion 370*a* has a circular cross section corresponding to an outer circumferential surface of the supporting body 350 to become narrow downward, and a lower portion thereof may be sharply formed in a point or line shape.

That is, the through portion 370*a* may be formed in an upside-down cone shape, or may extend downward from the outer circumferential surface of the supporting body 350 to become narrow and to have a blade shape forming a linear blade.

Therefore, the supporting body 350 in which the through guide part 370 is coupled may be easily inserted into the insulator e by a pressure applied from an outer side.

Referring to FIG. 8, after the concrete c is cured and the plate material p is removed while the supporting body 350 is inserted into the insulator e, one side of the insulator e may be opened so that the through guide part 370 is exposed.

And a lower portion of the hollow coupling hole 351 may be opened by separating the exposed through guide part 370, and the anchor a may be inserted into the hollow coupling hole 351 and may be coupled into an anchor coupling hole 322 of a lifting body 320.

Here, the coupling portion 370*b* may be inserted through a lower opening of the hollow coupling hole 351. Since the coupling portion 370*b* supports an inner circumferential surface of the hollow coupling hole 351, the coupling portion 370*b* may prevent separation of the through guide part 370, when the supporting body 350 is pressed so that the through guide part 370 passes through the insulator e, and may accurately transmit the external force to the through guide part 370.

At this time, the coupling portion 370*b* may be screwed or fitted into the hollow coupling hole 351. Therefore, when the plate material p is separated so that the through guide part 370 is exposed, and the insulator e is opened, the coupling of the coupling portion 370*b* may be easily released, and the through guide part 370 may be reused, and thus efficiency of the product may be enhanced.

Meanwhile, a plurality of fixing protrusions 353 may be provided on the outer circumferential surface of the supporting body 350 to be spaced from each other.

Preferably, a sliding portion 353*a* which is inclined upward is formed at a lower portion of the fixing protrusion 353 to press the insulator e and then to be inserted into the insulator e, and a hooking portion 353*b* which forms a step to be restricted in the insulator e is formed at an upper portion of the fixing protrusion 353.

At this time, the fixing protrusion 353 may be formed on the outer circumferential surface of the supporting body 350 to have a wing shape which protrudes up and down. The fixing protrusions 353 may be arranged to be spaced from each other.

Here, when the supporting body 350 is inserted into the insulator e, a frictional force is reduced by the sliding portion 353*a*, and thus the fixing protrusion 353 is slid through the insulator e and smoothly inserted into the insulator e, and also prevents separation of the insulator e through the hooking portion 353*b* after the separating of the plate material, and thus a coupling force between the insulator e and the concrete may be improved.

Therefore, when the concrete is poured, the insulator e may be installed together without a inconvenient process in which the insulator is installed after the concrete construction, and thus the convenience of the construction may be enhanced and also the coupling force between the concrete and the insulator may be improved, and the construction quality may be enhanced.

Preferably, a fixing nail 371 is insert-molded at a lower end of the through guide part 370 to pass through the insulator e and to be inserted into the plate material p.

Here, when the through guide part 370 is inserted through a surface side of the plate material p, the fixing nail 371 is inserted and fixed into the plate material p, and thus the through guide part 370 and the supporting body 350 coupled to the through guide part 370 may be more firmly fixed to an inner side of the insulator e.

And when the plate material p is separated after the curing of the concrete, a position of the through guide part 370 may be confirmed through an end of the fixing nail 371 protruding outward from the insulator e.

Therefore, when the insulator e is opened to couple the anchor, an accurate cutting operation corresponding to the position of the through guide part 370 may be performed, and thus a loss of the insulator may be minimized, and the construction quality may be enhanced.

Figure 9:
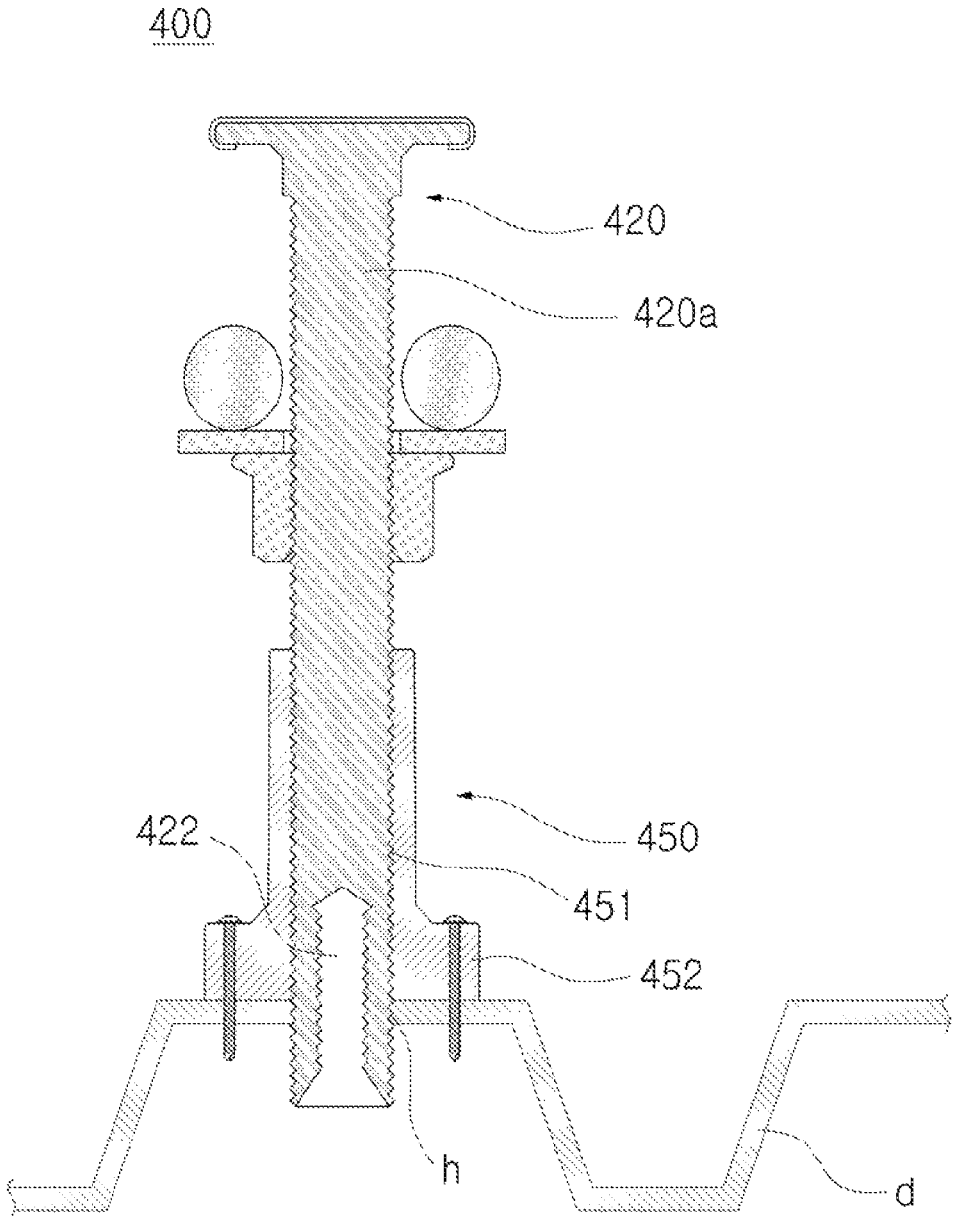
FIG. 9 is a cross-sectional view of a multiple cast-in insert apparatus for concrete according to a fifth embodiment of the present invention.

Meanwhile, FIG. 9 is a cross-sectional view of a multiple cast-in insert apparatus for concrete according to a fifth embodiment of the present invention. In the fifth embodiment, since basic configuration, except that the plate material is formed of a structural deck plate d, is the same as that of the first embodiment, the detailed description thereof will be omitted.

As illustrated in FIG. 9, the plate material is not separated after the pouring of the concrete, but is coupled to the concrete, and thus may be formed of the structural deck plate d which enhances a structural force of the concrete.

At this time, in the structural deck plate d, a bore h may be formed at an arrangement position of the anchor a. A supporting body 450 may be fixed to a peripheral portion of the bore h, and a hollow coupling hole 451 may be in communication with the bore h.

Specifically, the deck plate d is stalled at a pillar forming a frame of a building to construct a ceiling of the building, and the concrete is injected into the deck plate d to construct the ceiling.

At this time, the deck plate d may not be separated after the pouring of the concrete, but may be combined with the concrete to form the ceiling, and may be formed of a metallic material. Preferably, the deck plate d is formed of an aluminum material having a light weight and a high strength or a low-priced steel material having a high supporting force against the load.

Further, the supporting body 450 may be seated and fixed to the peripheral portion of the bore h and may be buried in the concrete, and the anchor a may be coupled to a lifting body 420 in the bore h.

Preferably, a diameter of the hollow coupling hole 451 is formed to be the same as or smaller than a diameter of the bore h. Further, a coupling part 420*a* may have a diameter smaller than that of the bore h, and may pass through the bore h to be exposed under the deck plate d.

A length of the coupling part 420*a* may be formed to be longer than a sum of a thickness of the deck plate d and a height of the supporting body 450, and while an upper end of the lifting body 420 is moved up to the pouring surface of the concrete, a lower end of the coupling part 420*a* may pass through the bore h and then may be exposed.

Therefore, since an anchor coupling hole 422 of the coupling part 420*a* may be exposed to an outer side through the bore h, the anchor coupling hole 422 may be visually confirmed at a lower surface of the deck plate d having a concavo-convex shape, and a position of the anchor coupling hole 422 may be easily confirmed, and thus workability may be improved.

Also, a flange 452 which protrudes outward may be formed at an outer circumferential surface of a lower end of the supporting body 450. The flange 452 may be fixed to the deck plate d through a steel plate piece, a double-sided tape, an adhesive, or the like. At this time, when the supporting body 450 is formed of a metallic material, the supporting body 450 may be coupled to the deck plate d by welding.

Figure 10:
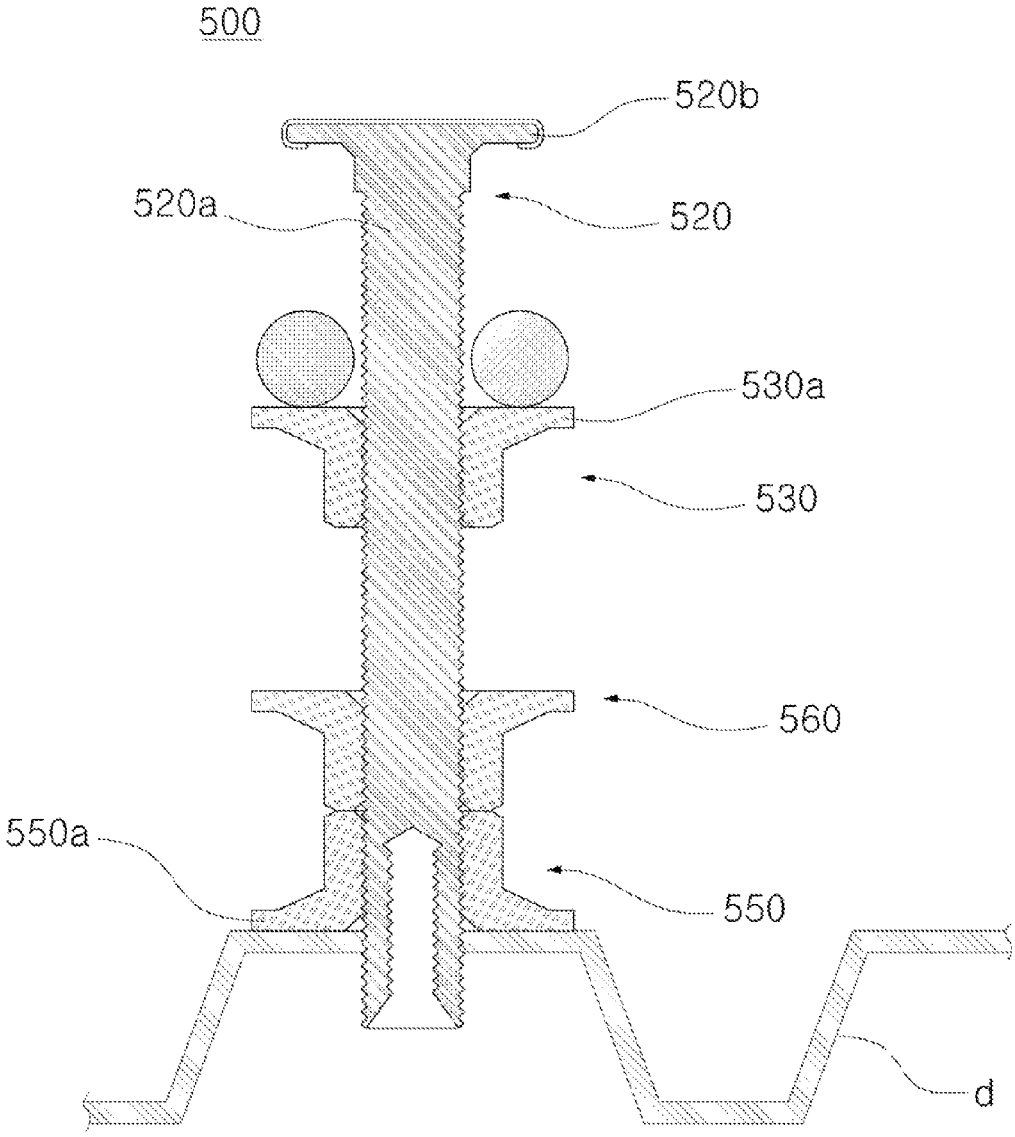
FIG. 10 is a cross-sectional view of a multiple cast-in insert apparatus for concrete according to a sixth embodiment of the present invention.

FIG. 10 is a cross-sectional view of a multiple cast-in insert apparatus for concrete according to a sixth embodiment of the present invention. In the sixth embodiment, since basic configuration, except a shape of a supporting body 550, is the same as that of the first embodiment, the detailed description thereof will be omitted.

As illustrated in FIG. 10, the supporting body 550 may be formed to have the same shape as a spacer body 530 and to be reversed up and down, and fixed to the deck plate d. At this time, a portion 550*a* corresponding to a seating part 530*a* of the spacer body 530 may be disposed downward to face the deck plate d, and thus may be coupled with the deck plate d by welding.

A stopper body 560 and the spacer body 530 may be coupled to a coupling part 520*a* above the supporting body 550. At this time, the supporting body 550, the spacer body 530, and the stopper body 560 are individually named according to each function, and may have the same shape.

At this time, when a lifting body 520 is moved up and down so that a leveling support part 520*b* is arranged at the predesigned pouring height of the concrete, the stopper body 560 is rotated downward to press the supporting body 550, and thus the lifting body 520 is fixed.

And the spacer body 530 may be moved up and down to correspond to the arrangement position of the rebar, and then the rebar is fixed. Therefore, the rebar may be accurately arranged at a position corresponding to the pouring thickness of the concrete.

Figure 11:
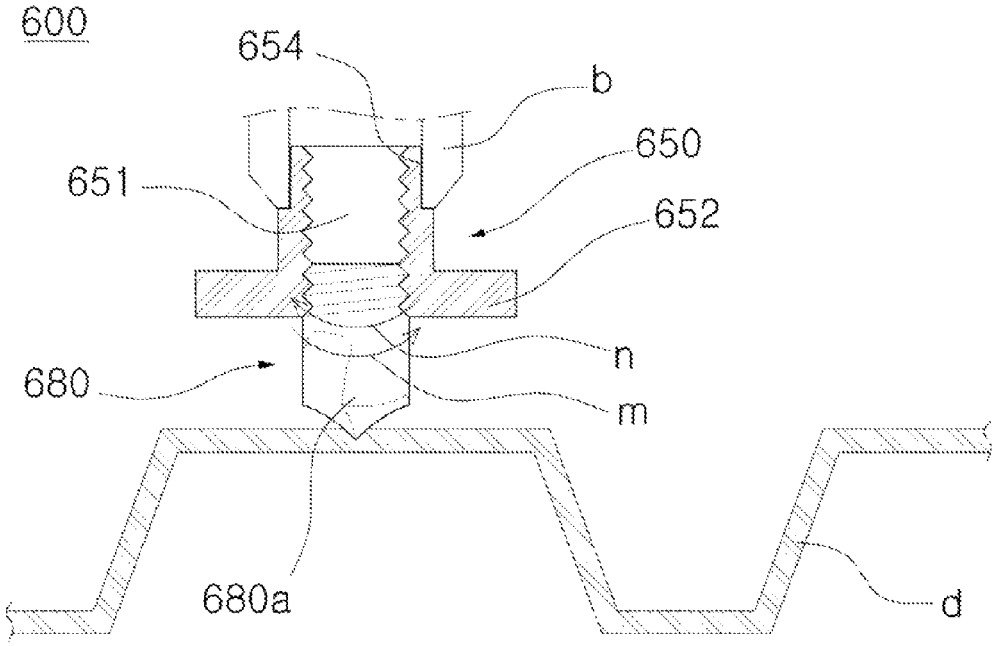
FIG. 11 is a schematic use diagram of a multiple cast-in insert apparatus for concrete according to a seventh embodiment of the present invention.

FIG. 11 is a schematic use diagram of a multiple cast-in insert apparatus for concrete according to a seventh embodiment of the present invention. In the seventh embodiment, since basic configuration, except a drilling part 680 provided at a lower portion of a supporting body 650, is the same as that of the first embodiment, the detailed description thereof will be omitted.

As illustrated in FIG. 11, the multiple cast-in insert apparatus 600 for concrete may further include the drilling part 680. The drilling part 680 may be removably coupled to a lower portion of a hollow coupling hole 651 so as to bore a hole in the deck plate d, when being rotated.

Specifically, the drilling part 680 may be screwed to the lower portion of the hollow coupling hole 651. When the drilling part 680 is rotated in the other direction, while being arranged at the lower portion of the hollow coupling hole 651, the drilling part 680 may be screwed and inserted into the hollow coupling hole 651.

A cutting blade 680*a* is formed at a lower portion of the drilling part 680. When the cutting blade 680*a* is rotated while being in contact with the deck plate d, the hole may be bored in the deck plate d. At this time, it is preferable that a cutting direction m of the cutting blade 680*a* and a screw-coupling direction n of the drilling part 680 are set reversely.

That is, a rotating direction of the cutting blade 680*a* for a cutting operation is preferably set to one direction which is opposed to the screw-coupling direction of the drilling part 680 into the hollow coupling hole 651.

Therefore, the drilling part 680 may be prevented from being released and separated from the hollow coupling hole 651 by a frictional force generated when the cutting blade 680*a* is rotated, and the cutting operation may be performed in a state in which the drilling part 680 is fixed.

Further, a drill engaging part 654 which is engaged with a drill chuck b to be integrally rotated is preferably formed at an upper end of an outer circumferential surface of the supporting body 650. Here, the drill engaging part 654 may be formed in a polygonal cross section or a D-cut shape to be integrally rotated with the drill chuck b.

Therefore, the drill engaging part 654 may accurately transmit a rotating force of the drill chuck b to the drilling part 680. At this time, the drill chuck b is provided at an end of an electric drill body to be spread or engaged by screw-tightening and thus to fix a drill having various shapes. Preferably, the drill chuck b is a general device which transmits the rotating force generated from a motor in the electric drill body to the drill.

Specifically, when the drilling part 680 is in contact with an anchor arranging position of the deck plate d, while being coupled to a lower portion of the supporting body 650, and then the rotating force is applied, the deck plate d may be cut and a hole may be bored.

When a flange 652 is in contact with the deck plate d, rotation of the drilling part 680 may be stopped, and the flange 652 may be coupled to the deck plate d. Then, the drilling part 680 may be separated, and the lifting body may be coupled to an upper portion of the supporting body 650, and a height thereof may be controlled according to the purposes of the leveler and the rebar spacer, and then the concrete may be poured.

As described above, instead of a method in which the hollow coupling hole 651 is aligned with a bore previously formed in the deck plate d, and the flange 652 is coupled therein, the hole is formed by the drilling part 680, and the hollow coupling hole 651 is automatically aligned, and thus the convenience of the product may be enhanced.

Figure 12:
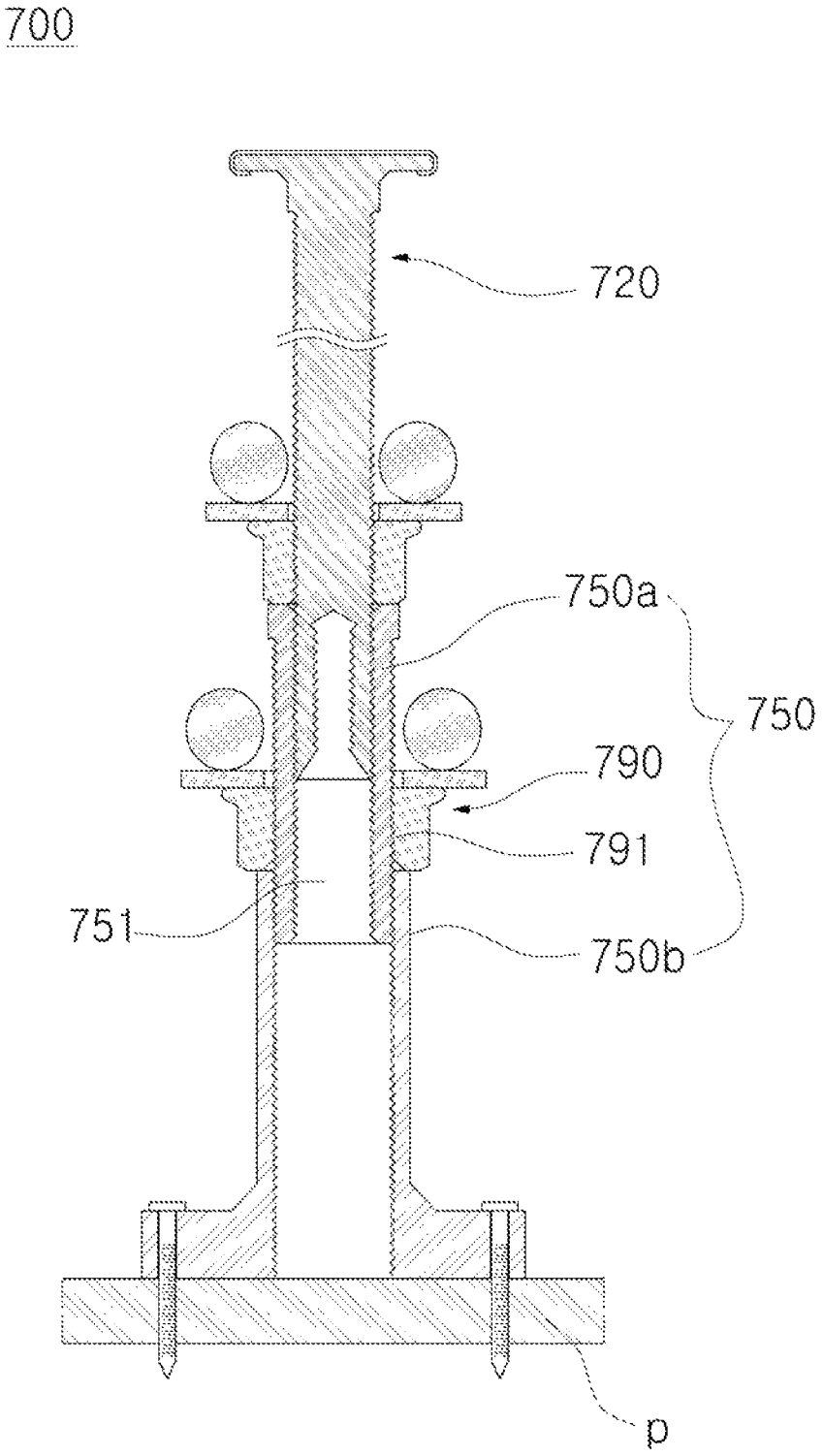
FIG. 12 is a cross-sectional view of a multiple cast-in insert apparatus for concrete according to an eighth embodiment of the present invention.

Meanwhile, FIG. 12 is a cross-sectional view of a multiple cast-in insert apparatus for concrete according to an eighth embodiment of the present invention. In the eighth embodiment, since basic configuration, except that a supporting body 750 is formed in a multistage manner, is the same as that of the first embodiment, the detailed description thereof will be omitted.

As illustrated in FIG. 12, the supporting body 750 may include a first supporting body 750*b* fixed to the plate material p, and a second supporting body 750*a* screwed to an inner side of the first supporting body 750*b* to be moved up and down.

A lifting body 720 may be screwed into a hollow coupling hole 751 formed at an inner side of the second supporting body 750*a*. Therefore, since the second supporting body 750*a* and the lifting body 720 may be moved up and down in the multistage manner, ranges of the thickness of the concrete and the arrangement distance of the rebar may be extended, and thus it is possible to be applied to various construction environments, and thus compatibility of the product may be improved.

A supporting body stopper 790 may be coupled to an outer side of the second supporting body 750*a*. Here, a supporting through-hole 791 through which the second supporting body 750*a* passes may be formed in the supporting body stopper 790, and the supporting through-hole 791 may be screwed to the second supporting body 750*a*.

And while the first supporting body 750*b* is fixed to the plate material p, a height of the second supporting body 750*a* is controlled, and an upper end of the first supporting body 750*b* is pressed through the supporting body stopper 790, and thus the second supporting body 750*a* may be fixed.

At this time, the rebar may be fixed to the supporting body stopper 790 by the welding or the rebar binding wire. Therefore, even in an engineering work which constructs a bridge, a tunnel and a road having a larger scale than a general construction work, the functions of the rebar spacer and the leveler may be performed to correspond to a multistage arrangement of the rebar and a thick thickness of the concrete.

Figure 13:
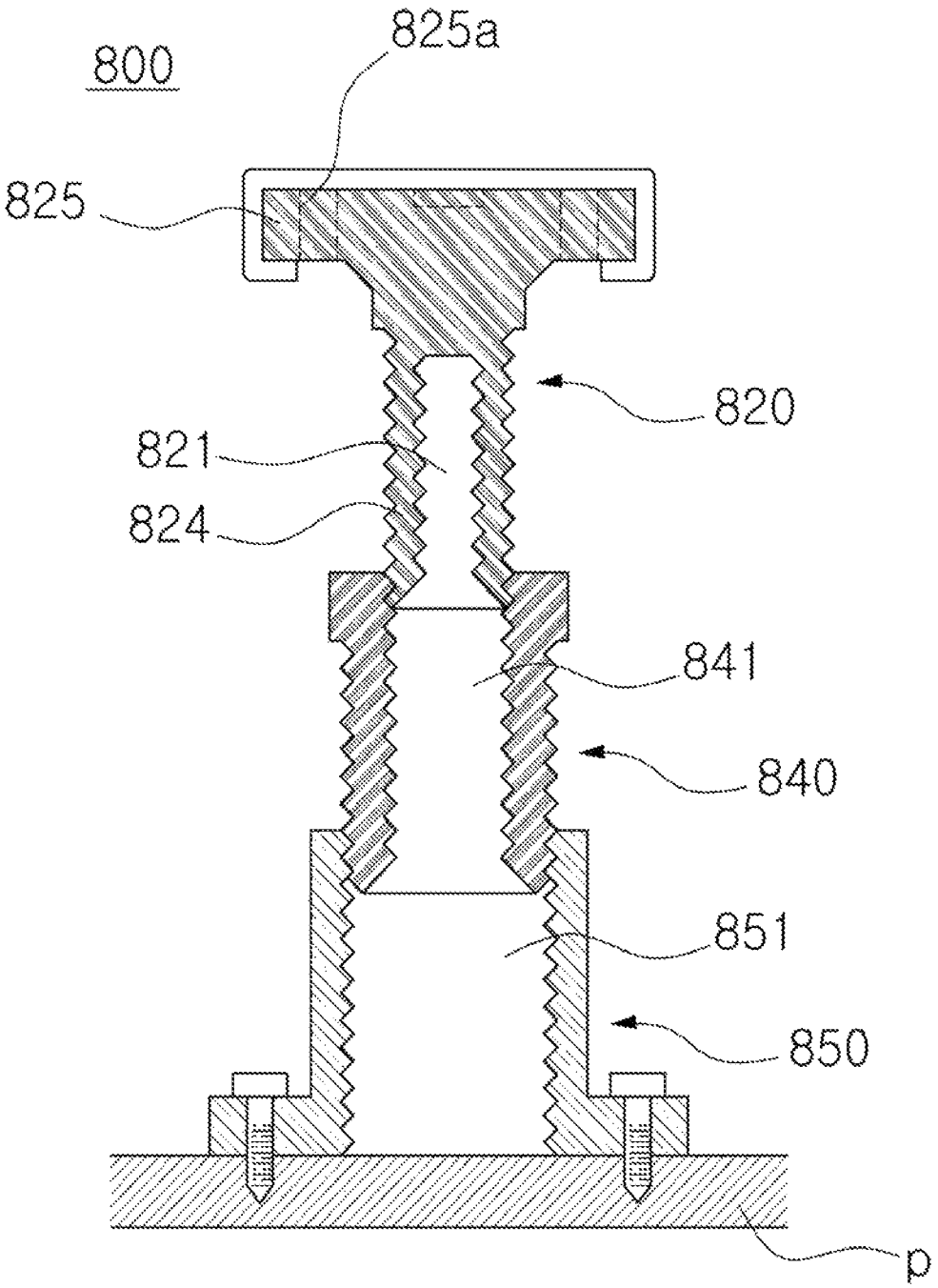
FIG. 13 is a cross-sectional view of a multiple cast-in insert apparatus for concrete according to a ninth embodiment of the present invention.

Meanwhile, FIG. 13 is a cross-sectional view of a multiple cast-in insert apparatus for concrete according to a ninth embodiment of the present invention. In the ninth embodiment, since basic configuration, except that an extension body 840 is provided at a center portion, is the same as that of the first embodiment, the detailed description thereof will be omitted.

As illustrated in FIG. 13, the supporting body 850 fixed to the cast in which the concrete is poured has an extension coupling hole 851 formed therein to pass therethrough. Further, an outer circumferential surface of the extension body 840 is screwed to the extension coupling hole 851 to be selective moved up and down, and the hollow coupling hole 841 is formed in the extension body 840 to pass therethrough.

Here, the coupling part 824 of the lifting body 820 is screwed to the hollow coupling hole 841 to be selectively moved up and down, and the anchor coupling hole 821 is formed therein. Further, the leveling support part 825 of the lifting body 820 is formed along an upper edge of the coupling part 824 to integrally protrude outward in a radial direction. At this time, an upper surface of the leveling support part 825 is preferably formed to be flat and thus to measure the pouring height of the concrete.

A plurality of holes 825*a* through which the rebar binding wires for binding the rebar pass may be formed at an edge of the leveling support part 825. The forming of the holes may be also applied to the first to eighth embodiments.

Since the extension body 840 is added, a longitudinal height of the multiple cast-in insert apparatus for concrete may be further varied and controlled, and it is possible to be applied to a case in which the thickness of the concrete is thicker.

Through the above embodiments, the multiple cast-in insert apparatus for concrete according to the present invention has the following effects.

First, the lifting body is moved up and down in the supporting body fixed to the plate material, and the leveling support part is provided as the pouring reference surface of the concrete, and the rebar is fixed to the spacer body moved up and down along the coupling part, and the functions of the rebar spacer and the leveler can be compatibly provided at various concrete heights/rebar arranging heights, and thus the design and preparation of the construction can be simplified, and the convenience of the product can be enhanced.

Second, since the spacer body is moved up and down along the coupling part and controlled according to the preset rebar arranging height, the rebar can be aligned at the accurate height, and also since the rebar can be temporarily supported by the seating part, the binding operation or the welding operation of the rebar can be easily performed without the assistance of another operator.

Third, after the height of the lifting body is controlled, the stopper body presses the upper end of the supporting body downward to push up the lifting body and thus to firmly fix the lifting body, and thus the rotation of the lifting body due to the movement pressure when the concrete is poured can be prevented, and the more accurate pouring standard can be provided, and thus the accuracy of the construction can be enhanced.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A multiple cast-in insert apparatus for concrete, comprising:

a supporting body configured to be fixed to a concrete form and having a first screw thread formed along an inner circumferential surface of a hollow coupling hole formed therein to pass therethrough;

a lifting body including a coupling part having a second screw thread formed on an outer circumferential surface thereof to be screwed into the first screw thread and thus to be selectively moved up and down through the hollow coupling hole and having an anchor coupling hole formed therein, and a leveling support part integrally formed as a unitary body with the coupling part along an upper edge of the coupling part to protrude outward in a radial direction; and a spacer body disposed above the supporting body and having i) a coupling through-hole formed therein so that the coupling part passes therethrough and ii) an upper surface on which a rebar configured to be installed in the concrete is seated between the leveling support part and the spacer body.

2. The apparatus of claim 1, wherein the spacer body include a coupling body having a third screw thread formed along an inner circumferential surface thereof to be coupled with the second screw thread and thus to be selectively moved up and down along the coupling part, and a seating part provided on an upper end of the coupling body to be expanded outward in the radial direction.

3. The apparatus of claim 2, wherein a plurality of wire insertion holes are formed in an outer circumferential surface of the seating part so that a rebar binding wire for fixing the rebar to the spacer body is inserted and bound therein.

4. The apparatus of claim 1, wherein a stopper body having a fourth screw thread formed along an inner circumferential surface of a press coupling hole formed therein to be coupled with the second screw thread and thus to press an upper end of the supporting body, when the stopper body is moved down, and thus to fix the lifting body is provided between the upper end of the supporting body and the spacer body.

5. A multiple cast-in insert apparatus for concrete, comprising:

a supporting body configured to be fixed to a concrete form and having a hollow coupling hole formed therein to pass therethrough;

a lifting body including a coupling part screwed into the hollow coupling hole to be selectively moved up and down and having an anchor coupling hole formed therein, and a leveling support part formed along an upper edge of the coupling part to integrally protrude outward as a unitary body with the coupling part in a radial direction; and a barrier cover which covers upper and side surfaces of the leveling support part, wherein the barrier cover is configured to expand when water is absorbed and to seal a portion between the leveling support part and the concrete.

6. The apparatus of claim 5, wherein the supporting body is formed of a reinforce synthetic resin and has a flange formed at an outer circumferential surface of a lower end thereof to protrude outward in a radial direction and thus to be coupled to one surface of the concrete form by a fastening means, and a stopper configured to contact with an upper edge of the supporting body to restrict screw-coupling is provided at an upper end of a screw thread formed on the outer circumferential surface of the coupling part to be screwed into a screw thread formed on an inner circumferential surface of the hollow coupling hole.

7. The apparatus of claim 5, wherein a through portion formed at a lower portion of the coupling part configured to pass through an insulator disposed at an upper side of the concrete form is formed at a lower portion of the supporting body.

8. The apparatus of claim 5, wherein a plurality of holes in which rebar binding wires are inserted and bound are formed at an edge of an outer circumferential surface of the leveling support part.

9. A multiple cast-in insert apparatus for concrete, comprising:

a supporting body configured to be fixed to a concrete form and having an extension coupling hole formed therein to pass therethrough;

an extension body screwed into the extension coupling hole to be selectively moved up and down and having a hollow coupling hole formed therein to pass therethrough;

a lifting body including a coupling part screwed into the hollow coupling hole to be selectively moved up and down and having an anchor coupling hole formed therein, and a leveling support part formed along an upper edge of the coupling part to integrally protrude outward as a unitary body with the coupling part in a radial direction; and a barrier cover which covers upper and side surfaces of the leveling support part, wherein the barrier cover is configured to expand when water is absorbed and to seal a portion between the leveling support part and the concrete.

* * * * *